US005356353A

United States Patent [19]

Takaoka

[11] Patent Number: 5,356,353

[45] Date of Patent: Oct. 18, 1994

[54] EXERCISED DEVICE HAVING AN APPARATUS FOR MONITORING AND CONTROLLING THE RANGE OF MOTION OF THE EXERCISE DEVICE

[76] Inventor: Hideo Takaoka, 20-12-108, Mama 5-chome, Ichikawa-shi, Chiba-ken, Japan

[21] Appl. No.: 146,461

[22] Filed: Oct. 29, 1993

Related U.S. Application Data

[63] Continuation of Ser. No. 887,782, May 22, 1992, abandoned.

[30] Foreign Application Priority Data

May 22, 1991 [JP] Japan ..... 3-146927

[51] Int. Cl.[5] ..... A63B 71/00

[52] U.S. Cl. ..... 482/9; 482/4; 482/5; 482/7

[58] Field of Search ..... 482/3, 5, 6, 8, 9, 900; 901/49

[56] References Cited

U.S. PATENT DOCUMENTS 4,235,437 11/1980 Ruis et al. ..... 482/5
4,540,331 9/1985 Stanner et al. ..... 901/49
4,735,410 4/1988 Nobuta ..... 482/9
4,907,795 3/1990 Shaw et al. ..... 482/9
4,976,424 12/1990 Sargeant et al. ..... 482/9

*Primary Examiner*—Richard J. Apley
*Assistant Examiner*—Lynne A. Reichard
*Attorney, Agent, or Firm*—Marshall & Melhorn

[57] ABSTRACT

Provided is a training equipment, comprising a fixed part, a movable part that is movable by a user relative to the fixed part in a first direction corresponding to a correct training pattern and a second direction corresponding to a deviation from the correct training pattern, and an indicator which notifies the user any deviation from the correct training pattern by using a visual, acoustic, or tactile signal. Optionally, the load or the resistance to the movement of the moveable part in the first direction may be increased with the increase in the deviation from the correct training pattern. Thereby, the user can develop highly efficient muscle power with the correct form and distribution of power because he is notified of any deviation from a correct form or a correct distribution of power substantially simultaneously in such a manner as may be considered as a feedback process.

12 Claims, 19 Drawing Sheets

EXERCISED DEVICE HAVING AN APPARATUS FOR MONITORING AND CONTROLLING THE RANGE OF MOTION OF THE EXERCISE DEVICE

This application is a continuation of application Ser. No. 07/887,782, filed May 22, 1992, now abandoned.

BACKGROUND OF THE INVENTION

1. Field of the Invention

The present invention relates to sports training equipment for increasing the muscle power and form of an athlete.

2. Summary of Related Art

To improve an athlete's performance in any sport match, the correction of the athlete's form and use of equipment, and the distribution and strength of his or her muscle power, is necessary. To improve muscle power, it is important not only to increase quantity of muscle, but also to improve and maximize the efficiency of the muscles through habitual training. Similarly, the correction of the athlete's form and muscle distribution is required to improve the athlete's performance.

In athletics, to provide the maximum performance, the separate and individual training for muscle power, form correction, and distribution of muscle power is not sufficient. These elements must be combined to provide the maximum performance.

Meanwhile, there are many different types of training equipment designed to increase muscle power:

(1) Large-sized training equipment where the user moves a movable part with a variable load, the movement of the part being restricted to a particular direction.

(2) Sit-up bench, which supports the user in a reclined position and permits the user to exercise with free form.

(3) Barbells and other free weights which permit the user to move and lift the weights with free form.

Among the equipment listed above, a structure in group (1) defines the movement of the user. As a result, the user gains the increase of muscle power, but there is little correction of athlete's form and distribution of power in this group of equipment.

The exercise equipment in groups (2) and (3) are also inefficient, because there is no means that restricts the movement and detects the correct form and movement. It is more desirable to have the athlete exercise to correct the form and the distribution of power instead of increasing muscle power only. The effect and efficiency of the training can be improved.

SUMMARY OF THE INVENTION

In view of such problems of the prior art, a primary object of the present invention is to provide training equipment that is highly effective in developing athletic skills.

A second object of the present invention is to provide training equipment which the user can use without an instructor or coach.

A third object of the present invention is to provide training equipment which is effective in preventing an athlete or a person just starting in athletics from developing undesirable form.

These objects of the present invention can be accomplished by providing training equipment for developing the desired sport skills, comprising: means for defining a correct training pattern; means for inputting a subject training pattern of a user to the training equipment; means for detecting deviation of the subject training pattern from the correct training pattern; and means for indicating the deviation to the user substantially simultaneously as the user inputs the subject training pattern.

According to the training equipment of the present invention, the user can develop highly efficient muscle power with the correct form and distribution of power because the user is notified of any deviation from a correct from or a correct distribution of power substantially simultaneously. This immediate feedback capability is an important part of the training equipment of the present invention.

Such an inventive concept can be implemented with a structure of training equipment comprising: a fixed part, a movable part that is movable by a user relative to the fixed part in a first direction corresponding to a correct training pattern and a second direction corresponding to a deviation from the correct training pattern; means for measuring the deviation of a movement of the movable part from the correct training pattern; and means for indicating the deviation measured by the measuring means to the user substantially simultaneously as the user moves the movable part and causes the deviation.

According to the preferred embodiment of the present invention, a progressively increasing or decreasing load or resistance is applied against movement of the movable part in the first direction with an increase in the deviation so that the user can readily perceive a deviation from a correct pattern, and learn the correct pattern more or less as a reflex.

In the case of an isokinetic training machine, the deviation may cause a change in the speed of the moveable part which, for instance, simulates a situation of a martial art in which one of the contenders pushes the opponent in an improper direction by his hands but his hands are forced to move faster by being evaded by the opponent. Alternatively, the indicating means may comprise an arbitrary combination of audio, visual and tactile alarm means.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
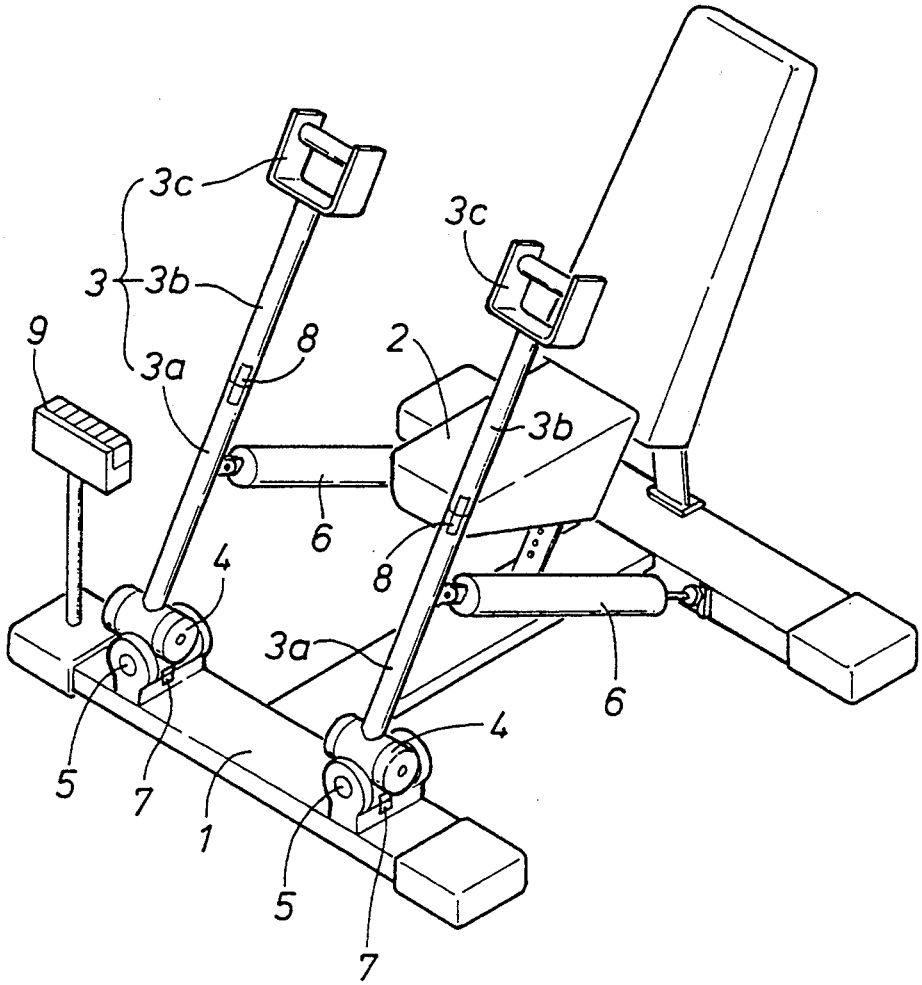
FIG. 1 is a schematic perspective view of a first embodiment of the present invention.

Referring to FIG. 1 showing an embodiment of the training equipment for increasing the muscle power of an athlete according to the present invention, a seat 2 is provided with an H-shaped base 1 on the floor for support of the user's body. A pair of movable arms 3 is provided, the arms 3 being located on either side of the seat 2 such that an axis extends in the lateral direction of the training equipment. The arms 3 are also pivoted about a pivot 5 such that a second axis extends in the fore-and-aft direction of the training equipment.

Each arm is divided into a bottom part 3*a* and upper part 3*b*. The upper part 3*b* is supported at the connecting point to the bottom part 3*a* by a bearing to facilitate sliding and rotating movement around the center axis of the bottom part 3*a*. A grip 3*c* is provided with the top of the upper part of each arm 3. An oil pressure cylinder 6 is attached to the bottom part 3*a* of each arm 3 to generate the load for revolving the arm 3. Therefore, the grip 3*c* of arm 3 is movable in all three axis.

A first switch 7 is provided with the pivot 5 to detect the proper movement of arm 3 around the center of the pivot 5. A second switch 8 is provided at the connection point between the upper part 3*b* and the bottom part 3*a* of the arms 3 to detect the slide and rotation of upper part 3*b*. These switches 7 and 8 are connected to the lamps on the control indicator station 9, which is located within the field of vision of the user. The station 9 consists of a plurality of indicating lamps.

When using this training equipment, the user, who sits on the seat 2 holding one of the grips 3*c*, can push and pull the arm 3 around the pivot 4 against the load that is generated by the oil pressure cylinder 6. If the form of the user is not correct, the lamp of the indicator station 9 starts to flash, because the switch 7 or 8 detects the slide of the arm 3 around the pivot 5 or the rotation of the upper part 3*b* of the arm 3 against the bottom part 3*a*. Therefore, the user can correct his form on his own by watching for flashing lights on the indicator station 9.

Figure 2:
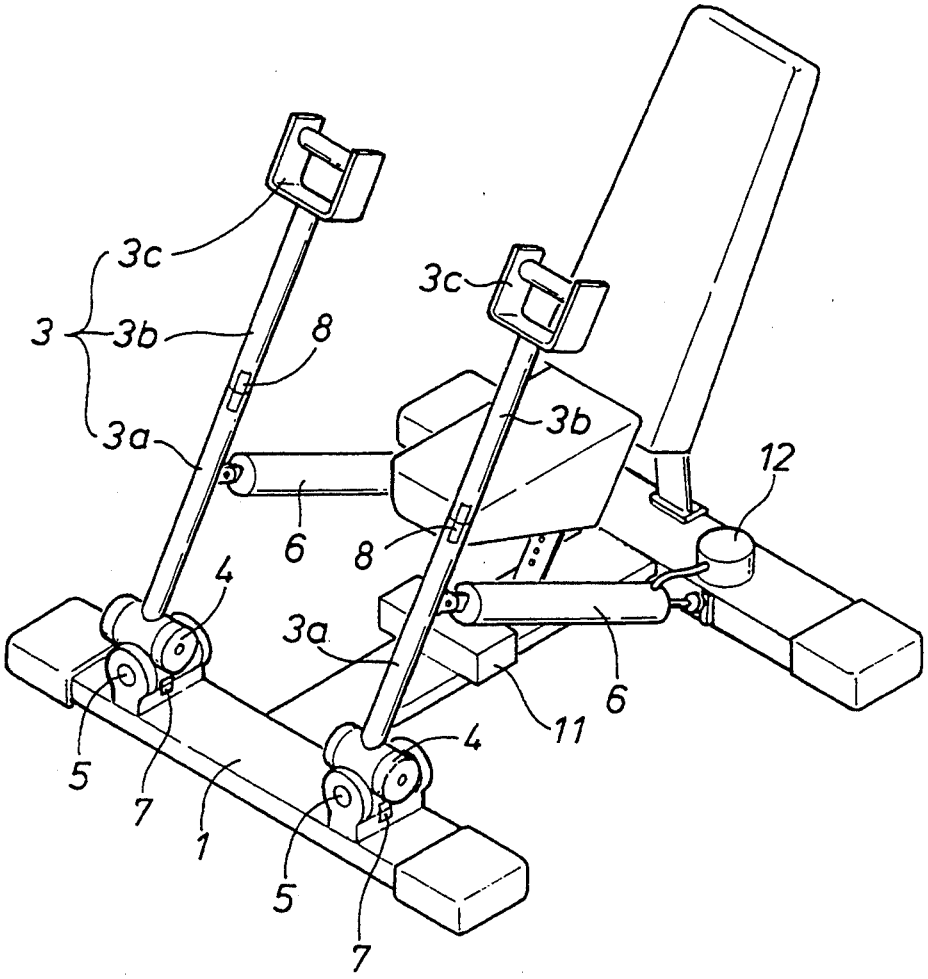
FIG. 2 is a schematic perspective view, similar to FIG. 1, of the variant of the first embodiment.

Referring to FIG. 2 which shows a variant of the first embodiment of the present invention, similar reference numerals will be used and the explanations for similar parts will be omitted. In this embodiment, switches 7 and 8, which are provided with the pivot 5 and arm 3, are the same as in the first embodiment. However, the output terminal for each of the switches is connected to a controller 11 mounted under seat 2. The controller 11, which is connected to the oil pressure control modules 12 for cylinders 6, can instruct the user to correct the operation of the arms 3 by changing oil pressure when the user's form is not proper such that the arm 3 rotates around the pivot 5 or the upper part 3*b* slides against the bottom part 3*a* of the arm 3.

Figure 3:
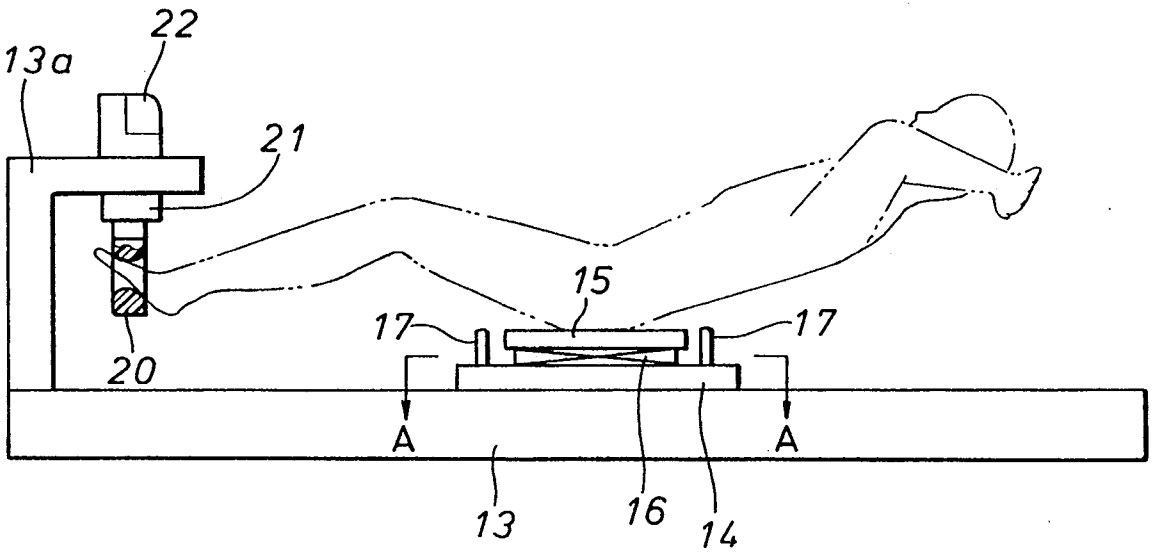
FIG. 3 is a side cross-sectional view of a second embodiment of the present invention.

FIG. 3 is a side cross-sectional view showing a second embodiment of the training equipment, such embodiment being utilized for exercising the abdominal muscles through sit ups and other similar exercises. A movable plate 15 is placed over the middle of the base 13 on the floor. The movable plate 15 is movable in all directions in parallel with the floor through a static pressure bearing 16 using the air pressure on a support plate 14 that is integrated with the base 13.

Figure 4:
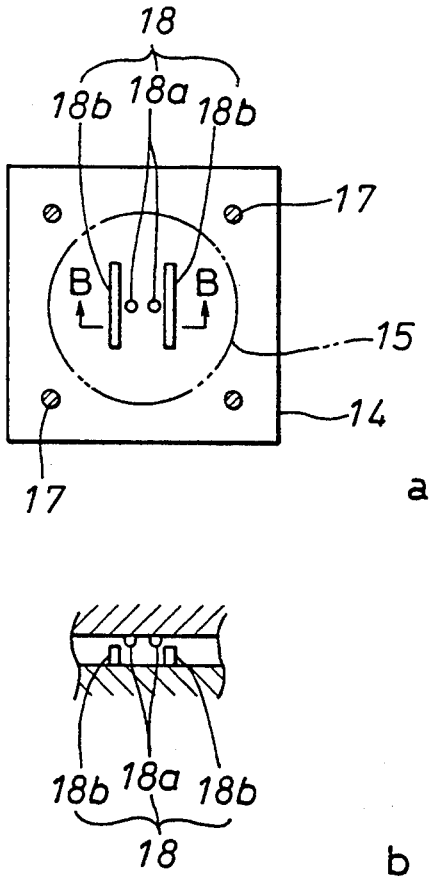
FIG. 4*a* is a vertical view taken along lines A—A in FIG. 3.
FIG. 4*b* is a vertical cross-sectional view taken along lines B—B in FIG. 4*a;*
Figure 5:
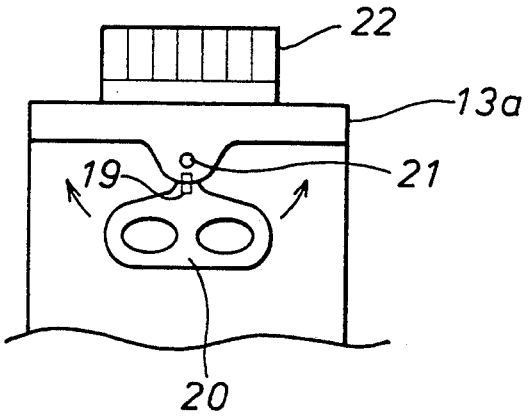
FIG. 5 is a fragmentary enlarged front view of FIG. 3.

The pins 17, which prevent the movable plate 15 from slipping off of the support plate 14, are provided at the four corners of the support plate 14. The support plate 14 and the pin 17 arrangement are generally square in shape as shown in FIG. 4*a*. The first switch 18 includes a pair of rails 18*b* and a pair of static pressure connect points 18*a* connected to the center of the movable plate 15 between the rails 18*b* as shown in FIG. 4*b* for detecting the deviation from the proper training pattern of the abdominal muscle exercises. The first switch 18 is connected to the indicator station 22 as shown in FIG. 3.

The foot support 13*a* is provided at the user's feet. A ring-shaped holder 20 for supporting the user's legs is provided with a pivot 21 that permits the holder 20 to move in a horizontal direction parallel to the floor and to rotate freely around the axis of the pivot 21.

The second switch 19 is provided with the pivot 21 to detect the rotation of the holder 20. Switch 19 is also connected to the indicator station 22. When using this training equipment, the user can sit on the movable part 15 and perform sit ups and other abdominal al exercises with the user's feet positioned on ring 20. If the user's form is not proper, the indicator station 22 detects the deviation by the switches 18 and 19 because of the displacement of the movable plate 15 and the rotation of the pivot 21 around holder 20. Therefore, the user can correct his form on his own by watching the lamps on the indicator station 22.

Figure 6:
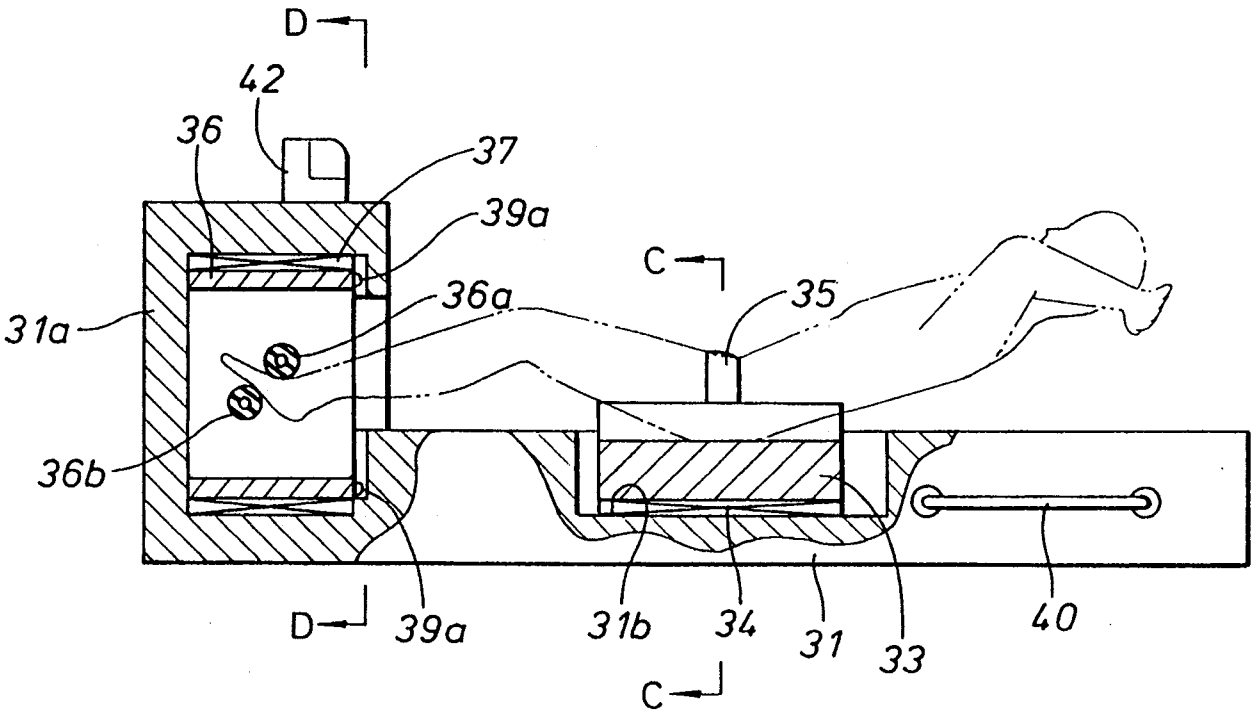
FIG. 6 is a fragmentary side cross-sectional view similar to FIG. 3 showing a third embodiment of the present invention.

FIG. 6 is a fragmentary enlarged front view showing a third embodiment of the training equipment for exercising the abdominal muscles similar to the second embodiment. In this embodiment, a semi-column-shaped holder 33, which is movable horizontally in motions parallel to the floor and which rotates freely around the axis to the seat 33, is supported by a bearing 34 on a concave groove 31*b* over the base 31. Similar to the second embodiment, a support 31*a* is provided at the user's legs. A holder 36, which is pivotable around a horizontal axis parallel to the floor and is movable in a horizontal direction, is supported by a bearing 37. A pair of bars 36*a* and 36*b* is provided inside the holder 36. The holder 36 and the seat 33 may be locked in a fixed position. The handles 40 are provided on both sides of the base 31 for positioning the user.

Figure 7:
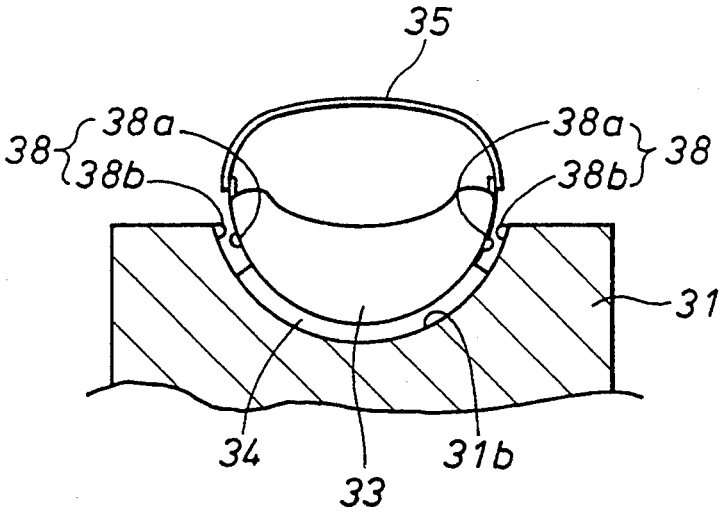
FIG. 7 is a vertical cross-sectional view taken along line A—A in FIG. 6.

In FIG. 7, contact points 38*a* for the first switch 38 are installed over the top of the support section 31*a* and connected to the indicator station 42. A second pair of contact points 38*b* is provided on the side of the base 31. The contacts 38*a* and 38*b* are engaged when the seat 33 starts to rotate. The switch 38 is adjustable corresponding to the allowable limits of the exercise.

Figure 8:
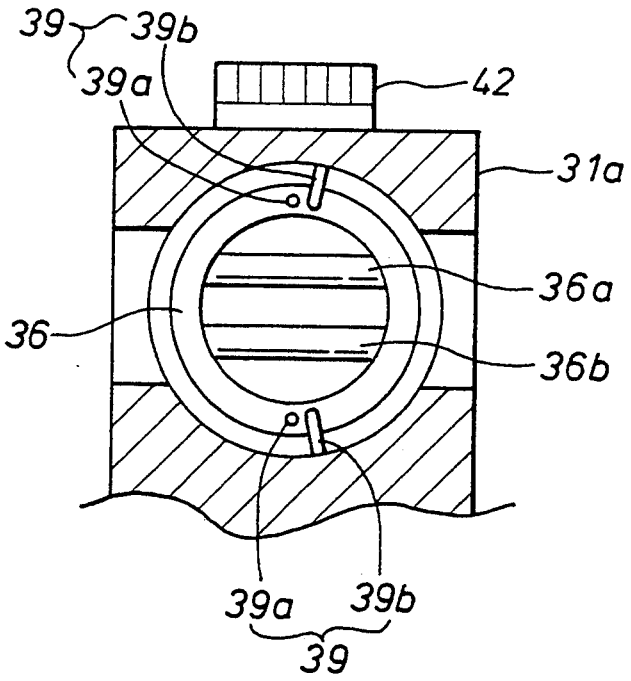
FIG. 8 is a vertical cross-sectional view taken along line D—D in FIG. 6.

In FIG. 8, the contacts 39*a* for a second switch 39 are provided on both sides of the holder 36 and are connected to the indicator station 42. Contacts 39*b*, which are connected with the contacts 39*a* when the holder 36 rotates, are also provided in the support part 31*a*. When exercising the abdominal muscles, if the form is not correct, the holder 36 and the seat 33 start to rotate and inform the user of the deviation by the indicator station 42. The bottom of the seat 33 is heavier to prevent the undesirable rotation of the seat 33 and the holder 36, which permits the user to keep his balance.

Figure 9:
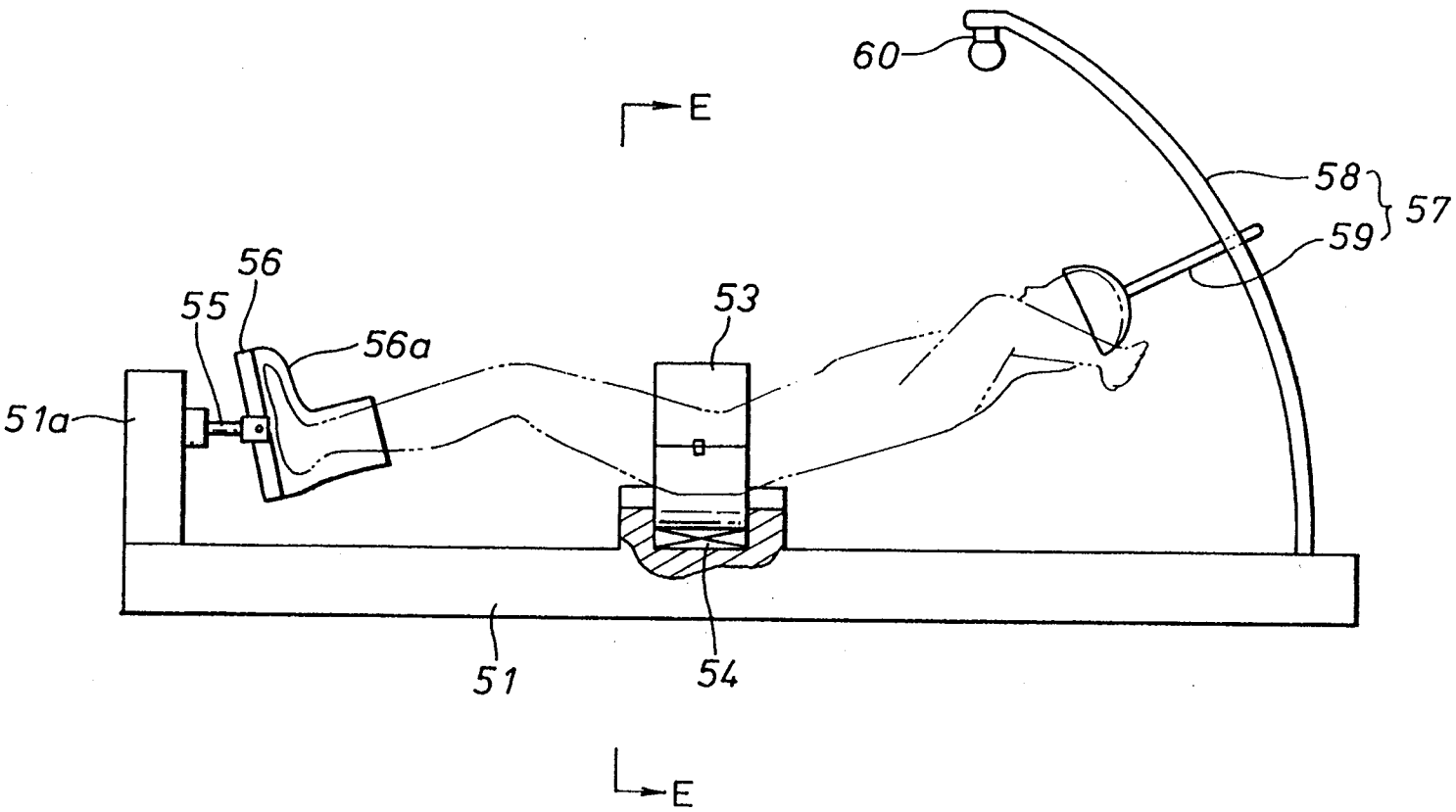
FIG. 9 is a fragmentary side cross-sectional view similar to FIG. 3 and FIG. 6 showing a fourth embodiment of the present invention.
Figure 10:
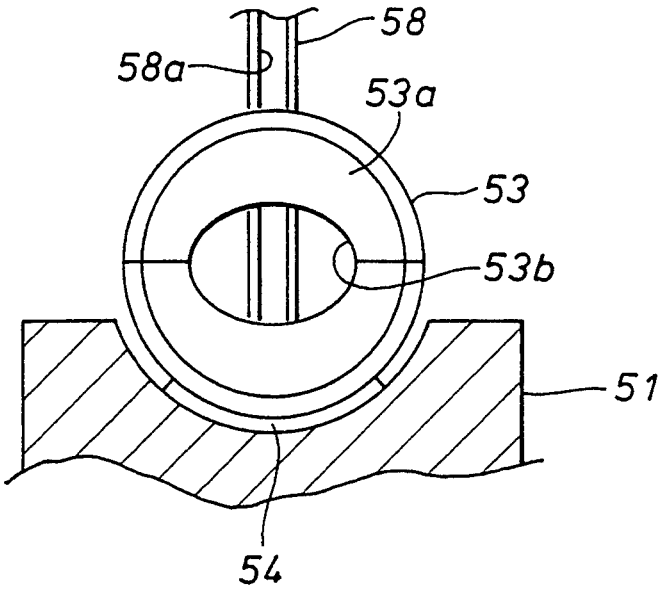
FIG. 10 is a vertical cross-sectional view taken along lines E—E in FIG. 9.

FIG. 9 is a fragmentary side cross-sectional view of the abdominal muscle training equipment showing a fourth embodiment of the present invention similar to the second and third embodiments. As a tube hip holder 53 is supported by the bearing 54 similar to the prior embodiments, and as the holder 53 is pivoted, the user can keep his balance, if the holder 53 rotates to the free angle. The pad 53*a* made from molded plastic is placed inside the holder 53. A hole 53*b* for the waist of the user is provided inside of the pad 53*a* (FIG. 10). The holder 53 is divisible into two parts, such that the user can place his waist in one side of the holder 53 and then close the holder 53 to fully support the waist of the user.

A support part 51*a* is provided at the user's legs on a base 51 similar to the third embodiment and a shaft 55 is also provided with the support part 51*a*. A support plate 56 attached to a shoe-shaped holder 56*a* is supported at the free end of the shaft 55 and is pivotable about the center axis. The shaft 55 is movable to according to the types of exercises being performed and the size of the user.

An arched arm guide 58 is provided as shown in FIGS. 9–10. A long channel 58*a* is provided in the guide arm 58 and the user can insert a shaft 59 into the channel 58*a*. The shaft 59 is positioned by the head and hands of the user. A switch 57 includes the guide arm 58 and the shaft 59. The switch 57 is connected to the indicator light 60 at the free end of the guide arm 58. The indicator light 60 will be turned on immediately after the shaft 59 contacts the guide arm 58. If the training of the back and abdominal muscles is not correct, the holder 53 and support plate 56 start to rotate because of the slant of the body. In this embodiment, the holder 53 and shaft 55 are rotatable to the free angle. The typical exercises for the back muscles could be completed by keeping the balance with a 180-degree of rotation.

Figure 11:
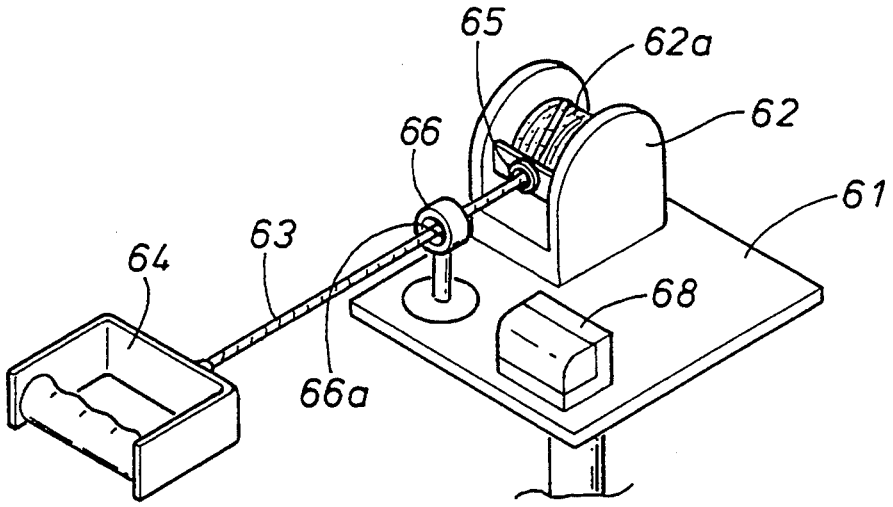
FIG. 11 is a schematic perspective view showing a fifth embodiment of the present invention.

FIG. 11 is a perspective view showing a fifth embodiment of the present invention. This embodiment is training equipment for increasing the strength of the shoulder and arm muscles. A reel device 62, which includes a rotatable reel part 62*a* on which wire 63 is wound, is mounted on a fixed base 61. A handle 64 for use by the user is attached to the free end of wire 63. The reel part 62*a* is biased in the wind-up direction. When the user pulls the handle 64 against the bias, muscle strength will be increased. A guide part 65, through which the wire 63 is extended, is attached to the reel device 62. The wire also extends through a hole 66*a* in a larger pipe sensor 66 mounted on the base 61 and spaced apart from the guide part 65. When the wire 63 contacts the surface of the hole 66*a*, an indicator station 68 which is connected to the sensor 66 turns on a lamp or sounds a buzzer to inform the user of the contact. Therefore, if the user does not pull the wire 63 in the preferred straight fashion, the user can correct his form by the energization of the indicator station 68.

Figure 12:
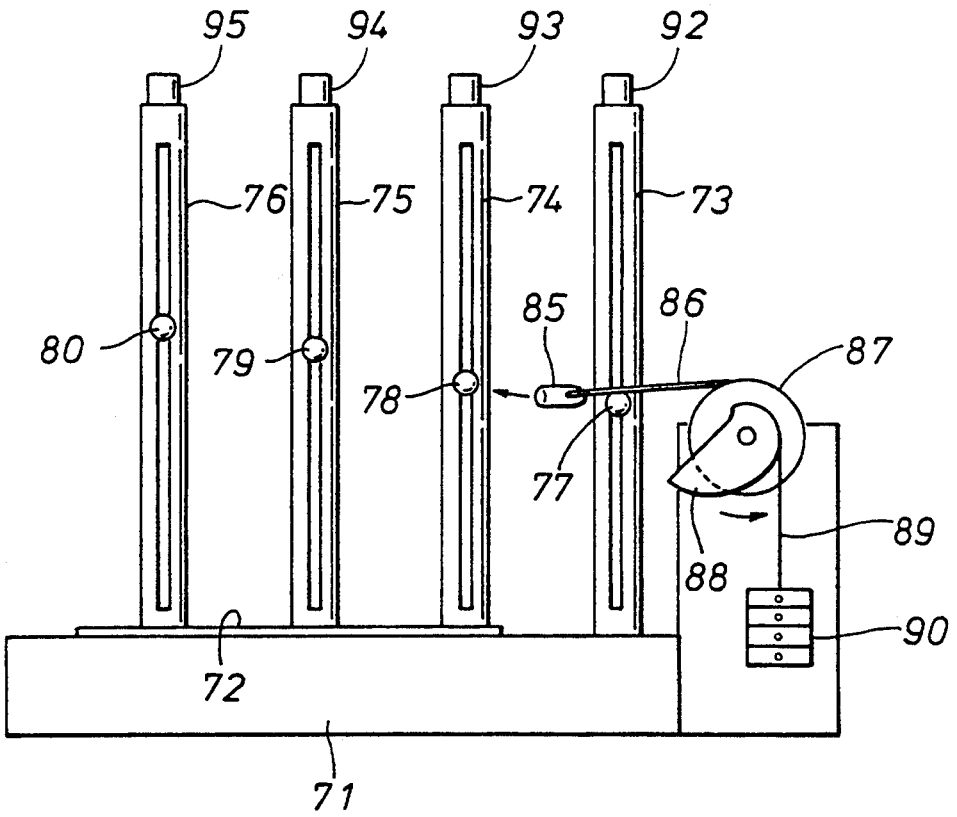
FIG. 12 is a fragmentary side cross-sectional view showing a sixth embodiment of the present invention.
Figure 13:
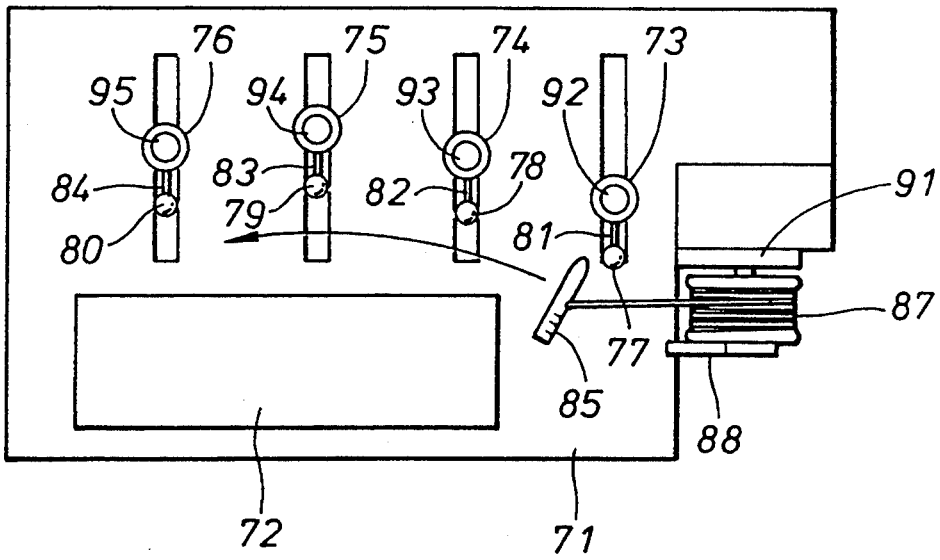
FIG. 13 is a plan view of FIG. 12.

FIG. 12 is a side view showing a sixth embodiment of the present invention. This is training equipment for the correction of the swing form and strength for baseball, tennis, and other bat and racquet games. A base 71 includes a foot plate 72 on which the user stands. Four poles 73, 74, 75, 76 are provided adjacent to the foot plate 72 to permit the user to set the proper swing course. Four balls 77, 78, 79, 80 are attached to the poles 73–76 by flexible bars 81, 82, 83, 84. The position of the poles 73–76 relative to the foot plate 72 is adjustable by sliding the poles 73–76 in the slots in base 71 as shown in FIG. 13. The height of the balls 77–80 can also be adjusted and set at the desired height by adjusting the bars 81–84.

A wire 86, which is connected with a racquet grip 85 that the user swings, is wound around a reel member 87 that is pivotably connected to the base 71. A cam 88 is attached to the reel member 87. A second wire 89 is wound around the cam face. The weights 90 are installed at the end of the wire 89.

When the user swings the racquet grip 85, from ball 77 through ball 80, the weights 90 are lifted by the cam 88. The cam 88 shape is formed to increase the load as the user pulls the wire 86. The user cannot finish the swing if the swing speed is slow. The reel member 87 includes a one-way clutch and a damper. The one way damper operates to pull back the racquet grip 85 with a speed that does not disturb the user's swing rhythm.

If the racquet grip 85 does not properly contact the balls 77–80, which serve as touch sensors, the lamps of the indicators 92, 93, 94, 95 at the top of the poles 73–76 do not turn on. When the user on the foot plate 72 swings the racquet grip 85 and the swing course is correct, the lamps of indicators 92–95 will turn on for a preset time and then turn off-automatically. When the swing course is not correct and the grip 85 does not contact the balls 77–80, the lamps connected to the balls which are not contacted in the proper manner remain off. When the swing is too slow, the user cannot convey the grip 85 to the ball 80 because of the increase in the load caused by the weights 90 connected to cam 88. When the grip 85 contacts the balls 77–80 with the proper swing speed, the user can develop the proper muscles and the desired swing form and speed.

The shape of the cam 88 can be varied according to the purpose of the exercises. The poles 73–76 are adjustable as shown in the FIGS. 12–13. In addition to tennis and ping pong, the training equipment could also be used for the wrist action of karate or the foot action in soccer.

Figure 14:
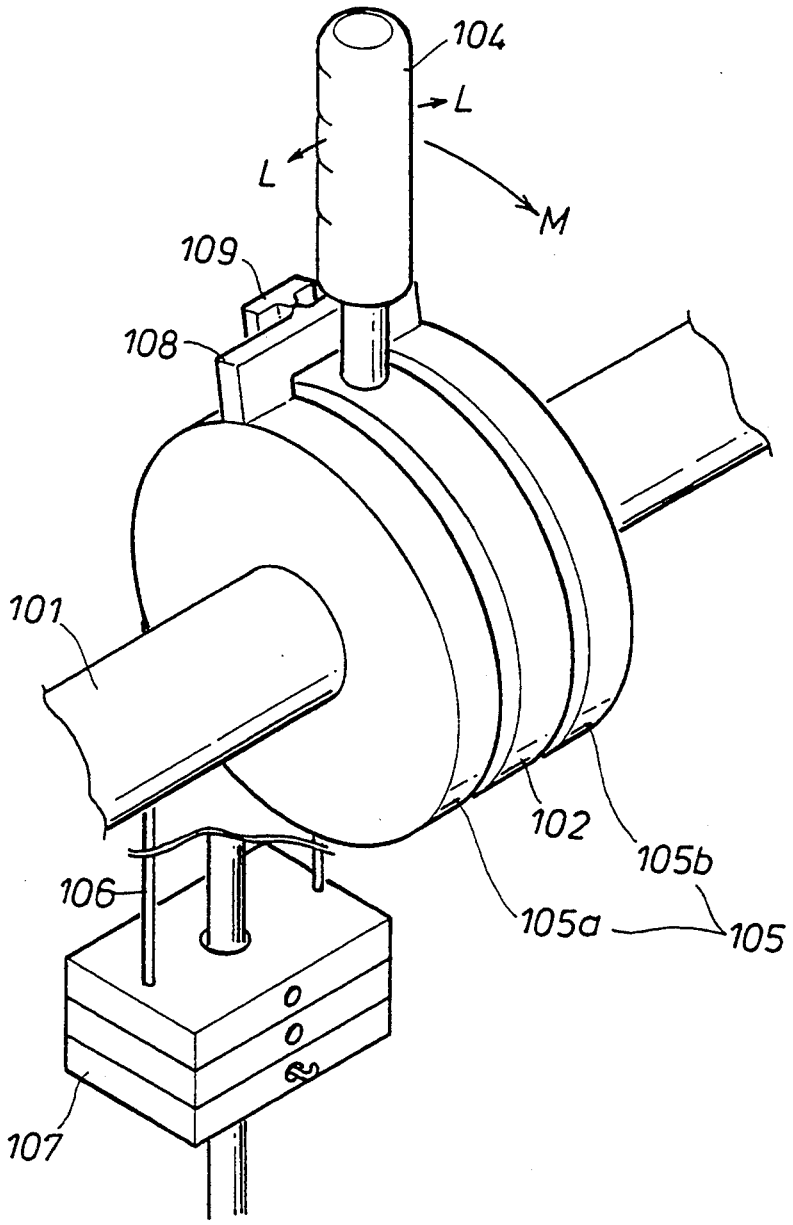
FIG. 14 is a schematic perspective view showing a seventh embodiment of the present invention.
Figure 15:
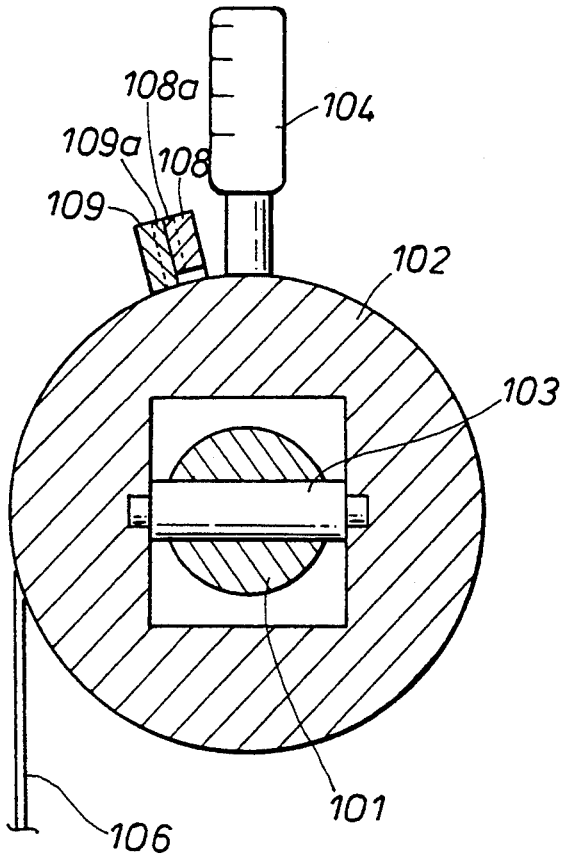
FIG. 15 is a side cross-sectional view of FIG. 14.
Figure 16:
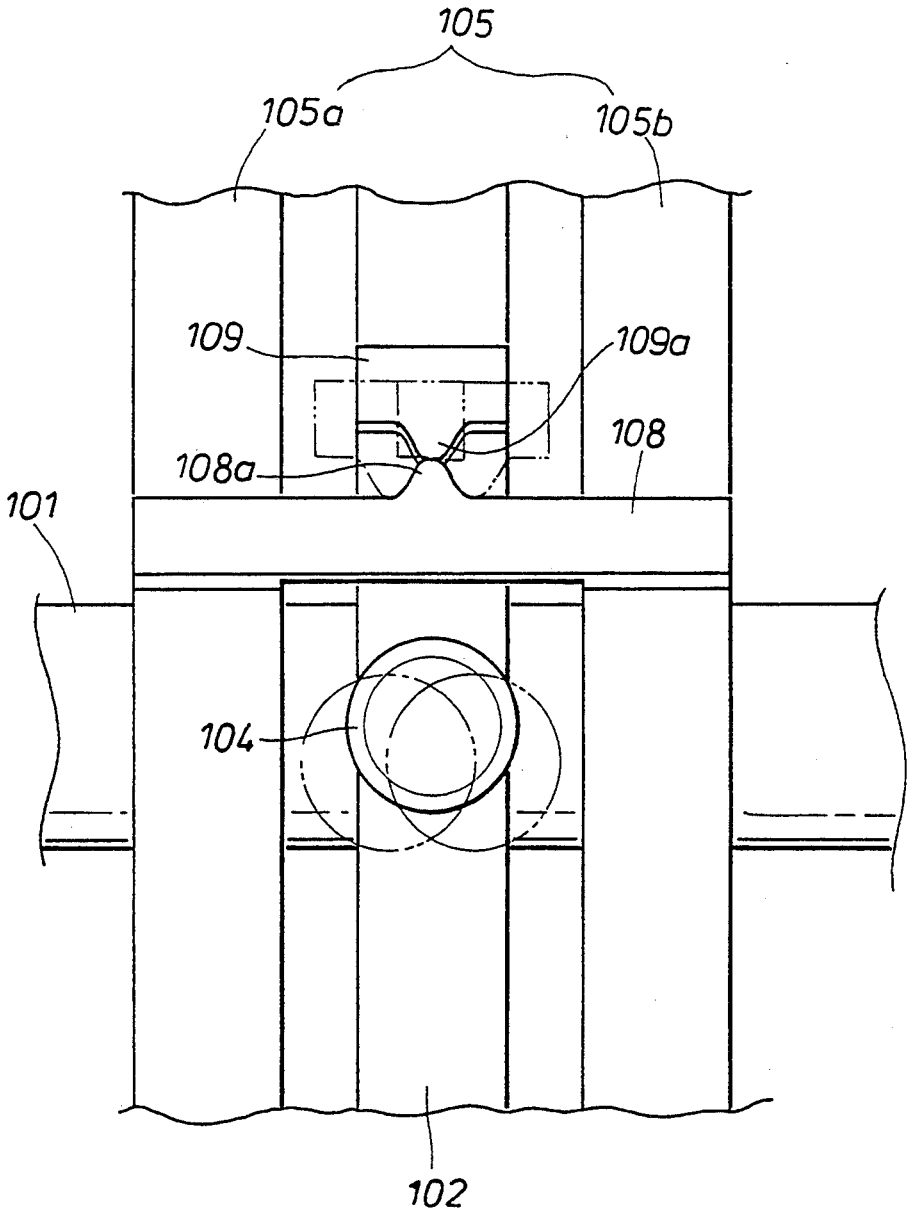
FIG. 16 is a plan view of FIG. 14.

FIGS. 14–16 are the perspective views showing a seventh embodiment of the present invention. The seventh embodiment is training equipment for the strength of the shoulder and arm muscles. A first movable disc-shaped member 102 is rotatable about shaft 101 in the direction "M" shown in FIG. 14 and is also movable about cross-shaft 103 (FIG. 15) in the direction "L" shown in FIG. 14. A handle 104 is affixed to the member 102 for moving the member 102.

A second movable disc-shaped member 105 includes a pair of disc-shaped members 105*a* and 105*b* that are positioned on shaft 101 on either side of the first disc-shaped member 102. A wire 106 is wound on the edge surfaces of both members 105*a* and 105*b*. The weights 107 are selectively attached to the other end of the wire 106. The disc-shaped parts 105*a* and 105*b* are connected by an abut member 108. An abut member 109 is provided over the first movable member 102 as shown in FIG. 16. A convex boss 108*a* part extending from part 108 abuts a similar convex boss 109*a* extending from part 109.

When the user shifts the handle 104 in the direction of the arrow "M", the weights 107 are lifted by the first moveable member 102 and the abut members 109 and 108 and the second movable member 105. When the handle 104 is moved in the direction of "L", the convex part 109*a* falls onto the surface area of 108 adjacent the boss 108*a* and the user is informed of the deviation from the proper movement by feeling a slight shock. The user can develop the arm and shoulder muscles by adjusting the distribution of power and correcting the form and swing.

Figure 17:
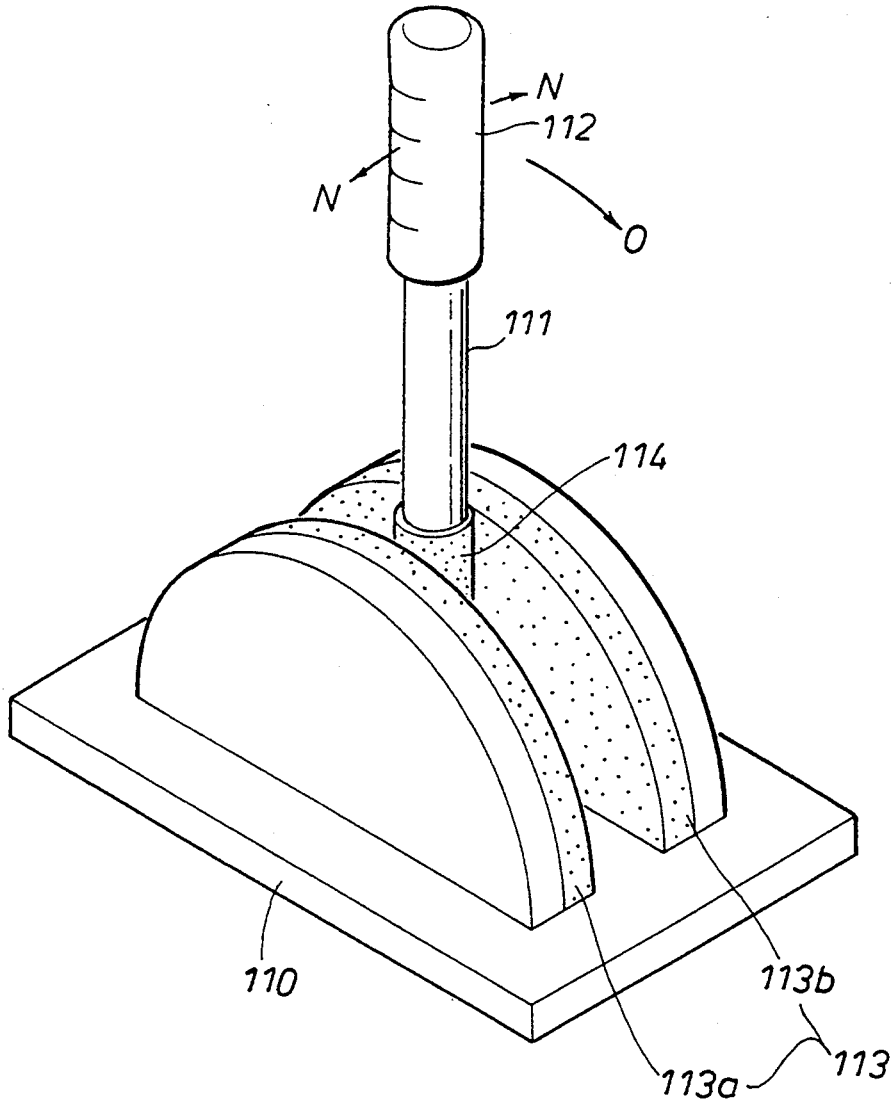
FIG. 17 is a schematic perspective view showing an eighth embodiment of the present invention.

FIG. 17 is a perspective view showing an eighth embodiment of the present invention. This is training equipment for increasing the strength of the shoulder and arm muscles. A bar 111 is rotatable in the direction of the arrow "O" about an axis in the base 110. A grip 112 is provided at the end of the bar 111. Similar to the seventh embodiment, the bar 111 is able to move in the direction of the arrows "N". A load (not shown) is connected to the bar 111. A frictional member 113 including a pair of semi-disc-shaped members 113*a* and 113*b* mounted on either side of the bar 111 on the base 110. A frictional member 114 is positioned around the bottom of the bar 111 and spaced-apart from the frictional members 113*a* and 113*b*.

When the user shifts the bar 111 in the direction of the arrow "O", the bar 111 moves against the load as desired. When moved in the direction of the arrow "N", the user is informed of the undesirable movement and deviation in the "N" direction by sensing the increased resistance in moving the bar 111 caused by the increased friction between frictional members 113 and 114. When the increased friction is sensed by the user, the user can correct the form as desired.

Figure 18:
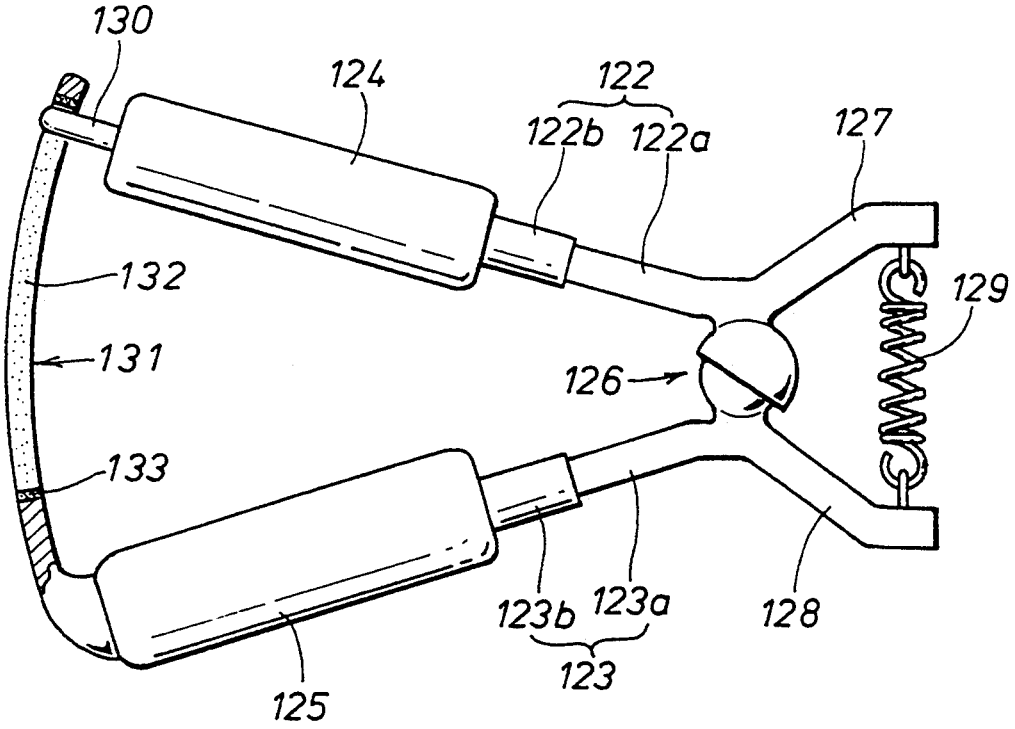
FIG. 18 is a fragmentary side cross-sectional view showing a ninth embodiment of the present invention.
Figure 19:
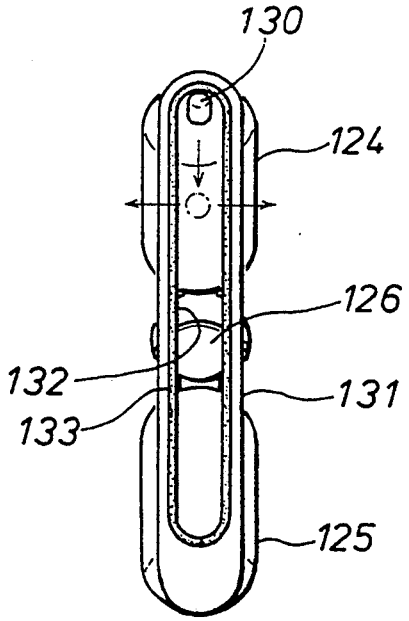
FIG. 19 is a front view of FIG. 18.

FIGS. 18 and 19 are the ninth embodiment of the present invention. This embodiment is training equipment for increasing the grip strength of the user. The training equipment includes a pair of arms 122 and 123 that are provided with the grips 124 and 125, respectively. A ball joint 126 pivots as shown in the FIGS. 18–19 to permit the grips 124 and 125 move toward and away from each other. A pair of support arms 127 and 128 are located on the opposite side of the ball joint 126 from the arms 122 and 123. A coil spring 129 biases the handles 124 and 125 of the arms 122 and 123 to move away from each other.

Telescopic handle parts 122*a*–122*b* and 123*a*–123*b* permit the position of the grips 124 and 125 to be adjusted.

A projection 130 is provided at the outer end of handle 122 at grip 124. Guide part 131, formed at the outer end of handle grip 125 on bar 123, is provided with a slot 132 for guiding the relative movement of projection 130. The projection 130 penetrates the slot 132 as shown in FIG. 19. A frictional surface 133 is provided on the inner walls of the slot 132 in the guide part 131 with a slight space permitted between projection 130 and the surface 133. When the handles 122 and 123 are compressed by moving grips 124 and 125 closer together, the user can correct his form when sensing an increase in resistance caused by the friction between the projection 130 and the frictional surface 133.

Although the present invention has been described in terms of specific embodiments, it is possible to modify and alter details thereof without departing from the spirit of the present invention.

What we claim is:

1. A structure of a training equipment for use during an exercise routine, said structure comprising:

a fixed part mounted on a base;

a movable part that is movable by a user relative to said fixed part and to the base in a plurality of trajectories during an exercise routine;

a plurality of sensors adjustably mounted on said fixed part and the base for defining two or more acceptable trajectories for said movable part, said sensors being mechanically actuatable and transmitting a signal upon actuation; and actuator means integrally formed in said movable part for actuating one or more of said sensors, said actuator means mechanically engaging one or more of said sensors when a movement of said movable part during an exercise routine deviates from said acceptable trajectories.

2. A structure of a training equipment according to claim 1, including an indicating means connected to said plurality of sensors, said indicating means receiving a signal from one or more sensors to provide an instantaneous alarm signal to said user when a deviation from said acceptable trajectories has occurred during an exercise routine.

3. A structure of a training equipment according to claim 1, including an adjustable load means selectively engaging said movable part for applying an adjustable load against movement of said movable part along said acceptable trajectory.

4. A structure of a training equipment according to claim 3, wherein said adjustable load means comprises a variable load selectively engaging said movable part, said adjustable load means increasing the load on said movable part when said deviation of said actuator means from said acceptable trajectory increases.

5. A structure of a training equipment according to claim 2, wherein said indicating means comprises means for monitoring a speed of said movable part during an exercise routine and displaying a signal representing the speed of said movable part.

6. A structure of a training equipment according to claim 2, wherein said indicating means comprises an audio alarm means.

7. A structure of a training equipment according to claim 2, wherein said indicating means comprises a visual alarm means.

8. A structure of a training equipment according to claim 2, wherein said indicating means comprises a tactile alarm means.

9. A structure of a training equipment according to claim 1, further comprising a first load applied against the movement of said movable part along said acceptable trajectories.

10. A structure of a training equipment according to claim 9, further comprising a second load larger than said first load applied against movement of said movable part along said acceptable trajectories with an increase in the deviation of said actuator means from said acceptable trajectories.

11. A structure of a training equipment according to claim 9, further comprising a second load less than said first load applied against movement of said movable part along said acceptable trajectories with an increase in the deviation of said actuator means from said acceptable trajectories.

12. A structure of a training equipment according to claim 9, further comprising an impulsive load applied to said movable part when the deviation of said actuator means from said acceptable trajectories has increased beyond a certain value.

* * * * *